US011882947B2

(12) United States Patent
Chow

(10) Patent No.: US 11,882,947 B2
(45) Date of Patent: Jan. 30, 2024

(54) PRODUCT DISPLAY

(71) Applicant: MARS, INCORPORATED, McLean, VA (US)

(72) Inventor: Terry A. Chow, Toronto (CA)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 17/762,240

(22) PCT Filed: Sep. 18, 2020

(86) PCT No.: PCT/US2020/051412
§ 371 (c)(1),
(2) Date: Mar. 21, 2022

(87) PCT Pub. No.: WO2021/055691
PCT Pub. Date: Mar. 25, 2021

(65) Prior Publication Data

US 2022/0330724 A1 Oct. 20, 2022

Related U.S. Application Data

(60) Provisional application No. 62/903,181, filed on Sep. 20, 2019.

(51) Int. Cl.

| | |
|---|---|
| ***A47F 5/11*** | (2006.01) |
| ***B65D 5/52*** | (2006.01) |
| ***B65D 25/10*** | (2006.01) |

(52) U.S. Cl.
CPC ..... *A47F 5/116* (2013.01); *A47F 5/114* (2013.01); *B65D 5/52* (2013.01); *B65D 5/526* (2013.01); *B65D 5/5213* (2013.01); *B65D 25/10* (2013.01)

(58) Field of Classification Search
CPC ..... A47B 43/02; A47B 45/00; A47B 47/06; A47B 55/06; A47B 61/06; A47F 5/0884; A47F 5/11; A47F 5/112; A47F 5/114; A47F 5/116; A47F 5/118; A47F 7/143; B65B 19/04; B65B 19/10; B65B 3/003; B65D 21/086; B65D 2401/15; B65D 25/06; B65D 25/10; B65D 2501/24184; B65D 2519/00611; B65D 2519/00691;
(Continued)

(56) References Cited

U.S. PATENT DOCUMENTS 3,918,631 A * 11/1975 Hackenberg ..... B65D 5/0281 206/362
2003/0150771 A1* 8/2003 Mason ..... A47F 5/112 206/730

(Continued)

FOREIGN PATENT DOCUMENTS

DE 202014002852 U1 4/2014
EP 1760000 A1 * 3/2007 ..... B65D 19/20

(Continued)

*Primary Examiner* — Anthony D Stashick
*Assistant Examiner* — Marcos Javier Rodriguez Molina

(57) ABSTRACT

Methods and apparatuses for displays are disclosed. The display includes a header and a stand, where the stand may be configured to house a plurality of consumer products. The header is movable between a shipping configuration and a display configuration, wherein it is shorter in the shipping configuration and requires little assembly to move to the display configuration.

19 Claims, 10 Drawing Sheets

(58) Field of Classification Search

CPC ..... B65D 2519/00711; B65D 2543/00101; B65D 2571/00222; B65D 2571/00228; B65D 2571/0066; B65D 2571/00734; B65D 35/02; B65D 41/00; B65D 43/20; B65D 47/286; B65D 5/0005; B65D 5/0227; B65D 5/0236; B65D 5/10; B65D 5/22; B65D 5/241; B65D 5/248; B65D 5/305; B65D 5/321; B65D 5/38; B65D 5/40; B65D 5/42; B65D 5/4262; B65D 5/44; B65D 5/50; B65D 5/505; B65D 5/5054; B65D 5/52; B65D 5/5213; B65D 5/524; B65D 5/526; B65D 5/5445; B65D 5/5475; B65D 5/5495; B65D 5/563; B65D 5/566; B65D 5/64; B65D 5/68; B65D 50/061; B65D 51/145; B65D 51/1688; B65D 51/227; B65D 51/248; B65D 51/2828; B65D 53/00; B65D 55/022; B65D 55/026; B65D 55/06; B65D 55/0881; B65D 55/14; B65D 63/1027; B65D 63/14; B65D 71/06; B65D 71/08; B65D 71/16; B65D 71/20; B65D 71/70; B65D 75/12; B65D 75/58; B65D 75/5827; B65D 77/20; B65D 77/2012; B65D 77/32; B65D 81/00; B65D 81/02; B65D 81/3848; B65D 83/00; B65D 83/0083; B65D 85/00; B65D 85/1045; B65D 85/10564; B65D 85/50; B65D 85/72; B65D 88/005; B65D 88/32; B65D 9/04; B65D 9/34; B65D 90/004; B65D 90/0073; B65D 90/08; B65D 5/16; B65D 5/443; B65D 5/445; B65D 5/448; B65D 5/5266; B65G 17/065; B65G 19/245; B65G 21/14; B65G 2207/40; B65G 23/00; B65G 41/008; B65G 41/02; B65G 47/519; B65G 63/004

USPC ..... 206/730, 736, 740, 751, 758, 766, 738, 206/739, 743; 211/134, 174, 72, 135; 248/174; 53/79, 147, 201, 227, 284.5, 53/329, 329.2, 370, 374.4, 397, 407, 415, 53/432, 436, 439, 443, 447, 448, 450, 53/452, 453, 459, 461, 467, 471, 476, 53/477, 479, 541, 542, 547, 548, 550, 53/553, 558, 559, 561, 567, DIG. 2; 220/6, 23.4, 23.8, 62, 200, 266, 345.1, 220/359.1, 520, 528, 608, 626, 633, 657, 220/658, 762, 813, 818, 840, 842; 221/1, 221/6, 8, 9, 15, 21, 24, 65, 75, 129, 133, 221/197, 232, 258, 263, 266, 281

See application file for complete search history.

(56) References Cited

U.S. PATENT DOCUMENTS

| | | | | |
|---|---|---|---|---|
| 2005/0103681 | A1* | 5/2005 | Aubry | B65D 5/4229 206/45.21 |
| 2006/0260979 | A1 | 11/2006 | Lutes | |
| 2007/0023319 | A1 | 2/2007 | Honkawa | |
| 2008/0236002 | A1* | 10/2008 | Virvo | B65D 5/5213 206/45.24 |
| 2015/0210423 | A1* | 7/2015 | Bevier | B65D 5/52 206/45.25 |
| 2016/0037913 | A1* | 2/2016 | Franck | A47B 57/10 211/208 |
| 2017/0238727 | A1* | 8/2017 | Ertl | G09F 1/065 |
| 2019/0008290 | A1* | 1/2019 | Ertl | B65D 21/086 |
| 2021/0307542 | A1* | 10/2021 | Burgert | A47F 5/116 |

FOREIGN PATENT DOCUMENTS

| | | | | |
|---|---|---|---|---|
| FR | 2639913 | A1 * | 6/1990 | B65D 5/0005 |
| FR | 2720720 | A1 * | 12/1995 | A47F 3/004 |
| FR | 2720720 | A1 * | 12/1995 | A47F 3/004 |
| WO | WO-2016024150 | A1 * | 2/2016 | B65D 5/5206 |

* cited by examiner

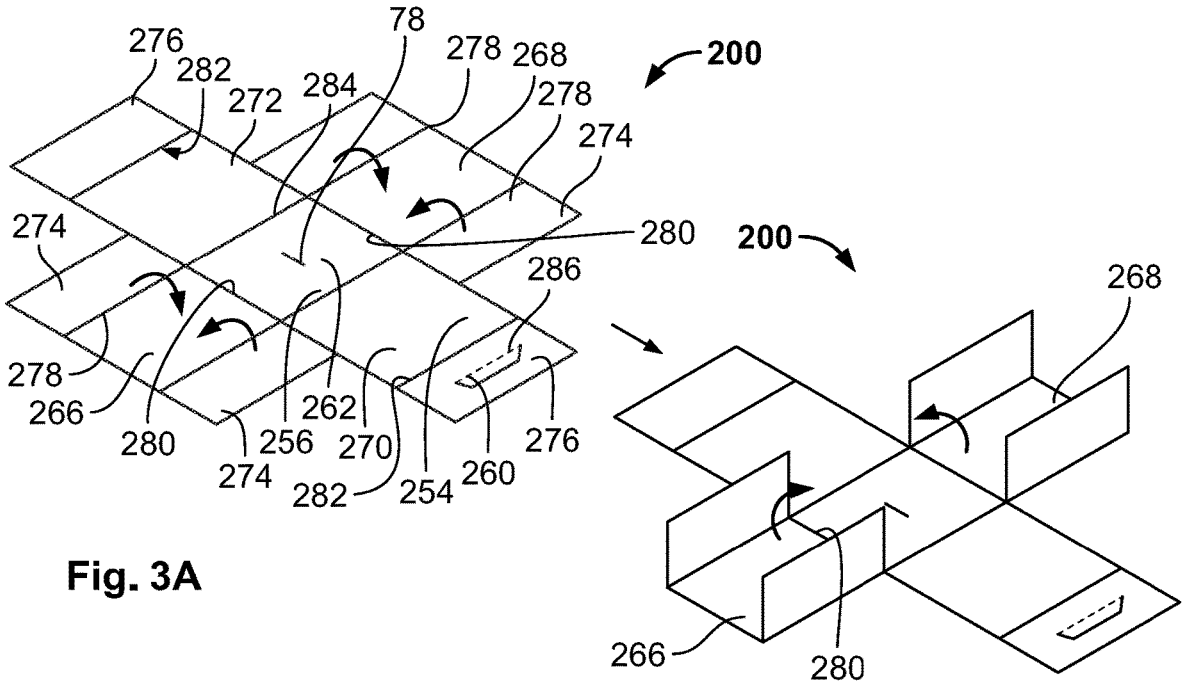
Fig. 3A
Fig. 3B
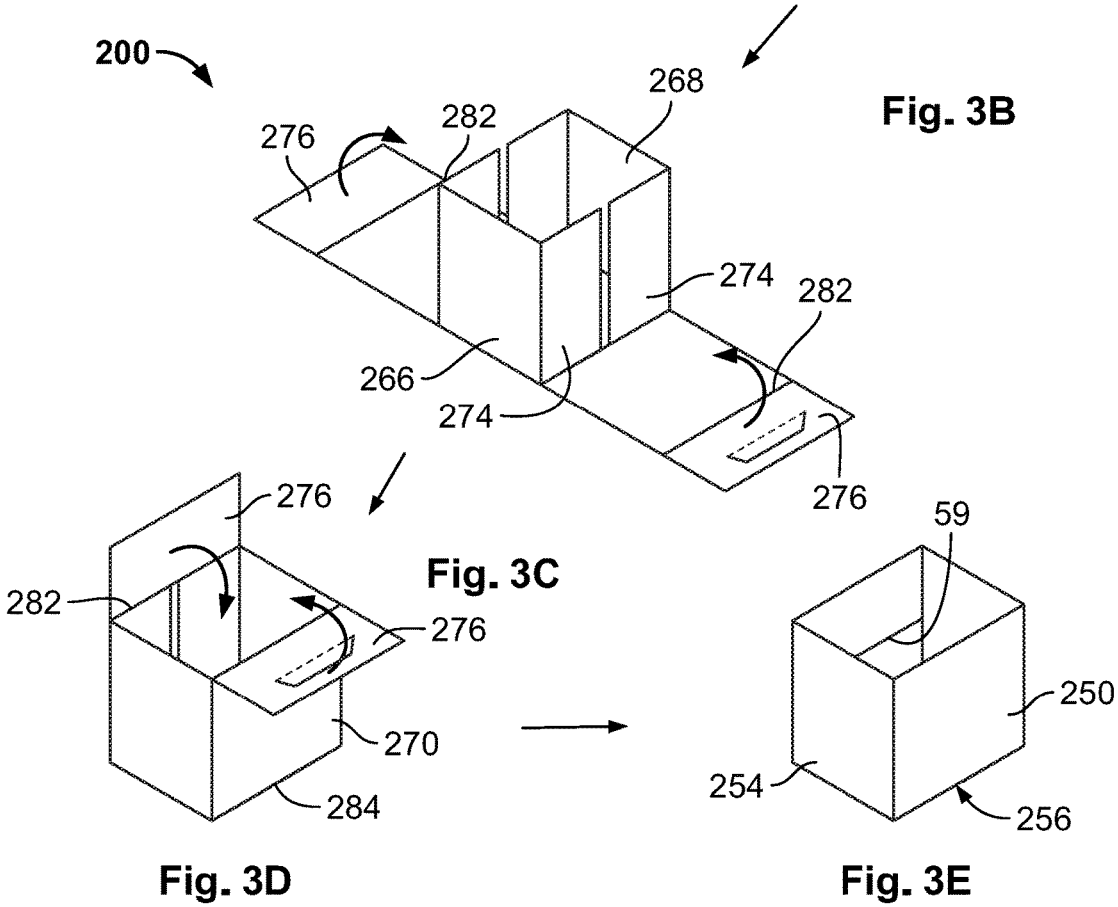
Fig. 3C
Fig. 3D
Fig. 3E

PRODUCT DISPLAY

BACKGROUND

Displays are often used in brick and mortar establishments to showcase consumer products in an attractive and convenient manner. In general, merchandising displays are box-like structures with trays, bins, or shelves sized to hold the merchandise for sale. It is preferable that the displays display merchandise in an aesthetically pleasing manner, draw attention to specific merchandise, and drive conversions. In particular, merchandise displays that are multi-dimensional, colorful, and an appropriate height can enhance the attractiveness of product being displayed and engage shoppers.

Sometimes displays are shipped flat and assembled at the point of use. The displays, however, often consist of multiple pieces which interlock and, as these displays become ever more sophisticated, the degree of expertise and training necessary to assemble them at a retail establishment increases accordingly. Time and know-how on the part of the establishment are required in order to build and use these displays to present merchandise to consumers. Unfortunately, some of these displays are not properly assembled or not assembled at all.

It is sometimes preferable that the displays come assembled to avoid errors constructing them at the retail establishment. However, displays can be quite bulky and difficult to transport in their assembled state. Given the size of standard shipping containers and internal warehouse racks it can be costly to ship pre-assembled displays. It can be especially costly to ship them if they are sized such that only a single layer of displays can be loaded into a standard tractor trailer or pallet. Shipping rates can be reduced if the displays are short enough such that the displays can be double stacked in a tractor trailer and/or on pallets.

In one example, floor displays that are 40 inches or less can typically be double stacked on a tractor trailer and on a pallet during transportation to their final destination. Floor displays of 40 inches or less are typically less aesthetically pleasing and not as noticeable in retail establishments compared to floor displays that are taller. As a result, some shorter floor displays are designed to have a decorative header display (also sometimes called a shroud or hood or protective cover) attached to the top of a stand to increase the height of the display several inches. One challenge is that in some cases a header is shipped separately from the stand resulting in situations where the header is not used because it is either lost or simply not available when the display is set up and not later added to the stand. Another challenge is that even if a header can be located, often times the assembler will incorrectly install the header on the stand and the display will not reach its full potential. In yet another challenge, even if the header is shipped in the box with a stand it may not be properly installed or applied. In some cases, the header may even be thrown out. Therefore, it would be desirable to have a display that addressed many, if not all, of these disadvantages.

What is currently needed is a merchandising display that is compact enough to transport cost-efficiently, tall enough to attract customers, easy to setup in an establishment, and aesthetically pleasing in use. What is needed is a merchandising display configured to easily go from a shorter shipping configuration to a taller display configuration with minimal or no effort, preferentially permitting the display to be placed directly upon a shelf or floor.

SUMMARY

One aspect of the present application provides an apparatus to display consumer products.

In a first aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration.

In a second aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration where the display in the first configuration is shorter than the display in the second configuration. The first configuration is a shipping configuration and the second configuration is a display configuration.

In a third aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The first configuration is a shipping configuration that is approximately 40 inches or less tall and the second configuration is a display configuration.

In a fourth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The header is moveable relative to the stand.

In a fifth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The header is moveable relative to the stand. The display also has a tab that attaches to the header to enable the header to move relative to the stand.

In a sixth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The header is moveable relative to the stand. The display also has a perforated tab that attaches to the header to enable the header to move relative to the stand.

In a seventh aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The header is moveable relative to the stand. The display also has a tab that attaches to the header to enable the header to move relative to the stand. When the display is in the second configuration the tab is not visible.

In an eighth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The stand has a plurality of trays configured to support a product.

In a ninth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The display includes a shelf configured to hold at least one packaged good.

In a tenth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The display includes a locking mechanism.

In an eleventh aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is shorter than the display in the second configuration. The display includes a locking mechanism with a tab on the stand and a tab on the header and when the two tabs are engaged the display is prevented from going into the first configuration.

In a twelfth aspect of the present disclosure, which may be combined with any other aspect listed herein unless specified otherwise, a display is provided. The display includes a stand adapted to support product for display in a retail location and a header coupled to the stand. The display is configured to go from a first configuration to a second configuration. When the display is in the first configuration it is 6 at least inches shorter than the display in the second configuration.

In a thirteenth aspect of the present disclosure, which may be combined with any other aspect listed herein unless specified otherwise, a merchandising header formed from a single blank is provided.

In a fourteenth aspect of the present disclosure, which may be combined with the thirteenth aspect in combination with any other aspect listed herein unless specified otherwise, a method for configuring an expandable display from a shipping configuration into a display configuration is provided. A display with a stand and a header coupled to the stand is provided. A user pulls the header along the stand such that the total height of the display increases.

In a fifteenth aspect of the present disclosure, which may be combined with any other aspect listed herein unless specified otherwise, a method for configuring an expandable display from a shipping configuration into a display configuration is provided. A display with a stand and a header coupled to the stand is contained within a container. The container is removed from the display and the header is pulled along the stand such that the total height of the display increases.

In a sixteenth aspect of the present disclosure, which may be combined with any other aspect listed herein unless specified otherwise, a method for configuring an expandable display from a shipping configuration into a display configuration is provided. A display having a stand and a header coupled to the stand and a perforated tab with two ends is provided. One end of the tab is engaged with the header and another end of the tab is engaged with a container. The container is removed such that the display is revealed.

In a seventeenth aspect of the present disclosure, which may be combined with any other aspect listed herein unless specified otherwise, a method for configuring an expandable display from a shipping configuration into a display configuration is provided. A display having a stand and a header coupled to the stand and a perforated tab with two ends is provided. One end of the tab is engaged with the header and another end of the tab is engaged with a container. The container is removed such that the display is revealed. The tab is perforated during removal of the container.

In an eighteenth aspect of the present disclosure, which may be combined with any other aspect listed herein unless specified otherwise, a method of converting a display in a shipping configuration into a display configuration is provided. A display with a stand and a header coupled to the stand is provided. The header encloses a portion of the stand. The header is vertically pulled along the stand to reveal the stand that was enclosed by the header.

In a nineteenth aspect of the present disclosure, which may be combined with any other aspect listed herein unless specified otherwise, a method of converting a display in a shipping configuration into a display configuration is provided. A display with a stand and a header coupled to the stand is provided. The header encloses a portion of the stand. The header is vertically pulled along the stand to reveal the stand that was enclosed by the header. The header is stopped vertically from being pulled after a locking mechanism on the header is engaged so that the header cannot move back to a previous configuration.

In a twentieth aspect of the present disclosure, which may be combined with the twentieth aspect of the present disclosure in combination with any other aspect unless specified otherwise.

In a twenty-first aspect of the present disclosure, any of the structure and functionality disclosed in connection with FIGS. 1-10 may be combined with any of the other structure and functionality disclosed in connection with FIGS. 1-10.

In light of the present disclosure and the above aspects, it is therefore an advantage of the present disclosure to provide an expandable display that can easily transform from a shipping to a display position.

The advantages discussed herein may be found in one, or some, and perhaps not all of the aspects disclosed herein.

Additional features and advantages are described herein, and will be apparent from, the following Detailed Description and the Figures.

BRIEF DESCRIPTION OF THE DRAWINGS

The accompanying drawings, which are incorporated herein and constitute part of this specification, illustrate certain preferred aspects of the invention, and, together with the general description given above and the detailed description given below serve to explain the features of the invention. In the drawings:

FIGS. 3A-3E are an assembly view of the header shown in FIG. 1, according to an example aspect.

DETAILED DESCRIPTION

While the invention is described in connection with certain preferred aspects, it is not intended that the present invention be so limited. On the contrary, it is intended to cover all alternatives, modifications, and equivalent arrangements as may be included within the spirit and scope of the invention as defined by the appended claims.

FIGS. 1-10 provide illustrative, non-limiting aspects of the present invention setting forth an exemplary method of assembling a merchandising display ("display") and the display apparatus formed thereby. Certain terminology is used herein for convenience only and is not to be taken as a limitation on the present invention. While the following describes certain illustrative aspects of the present invention, it should be understood, based on this disclosure that the invention is described by the claims, and is not limited by the aspects described herein.

The present disclosure provides product displays that may be pre-assembled, packed, shipped, and easily deployed in any of various retailers, wholesalers, and other brick-and-mortar establishments.

Figure 1:
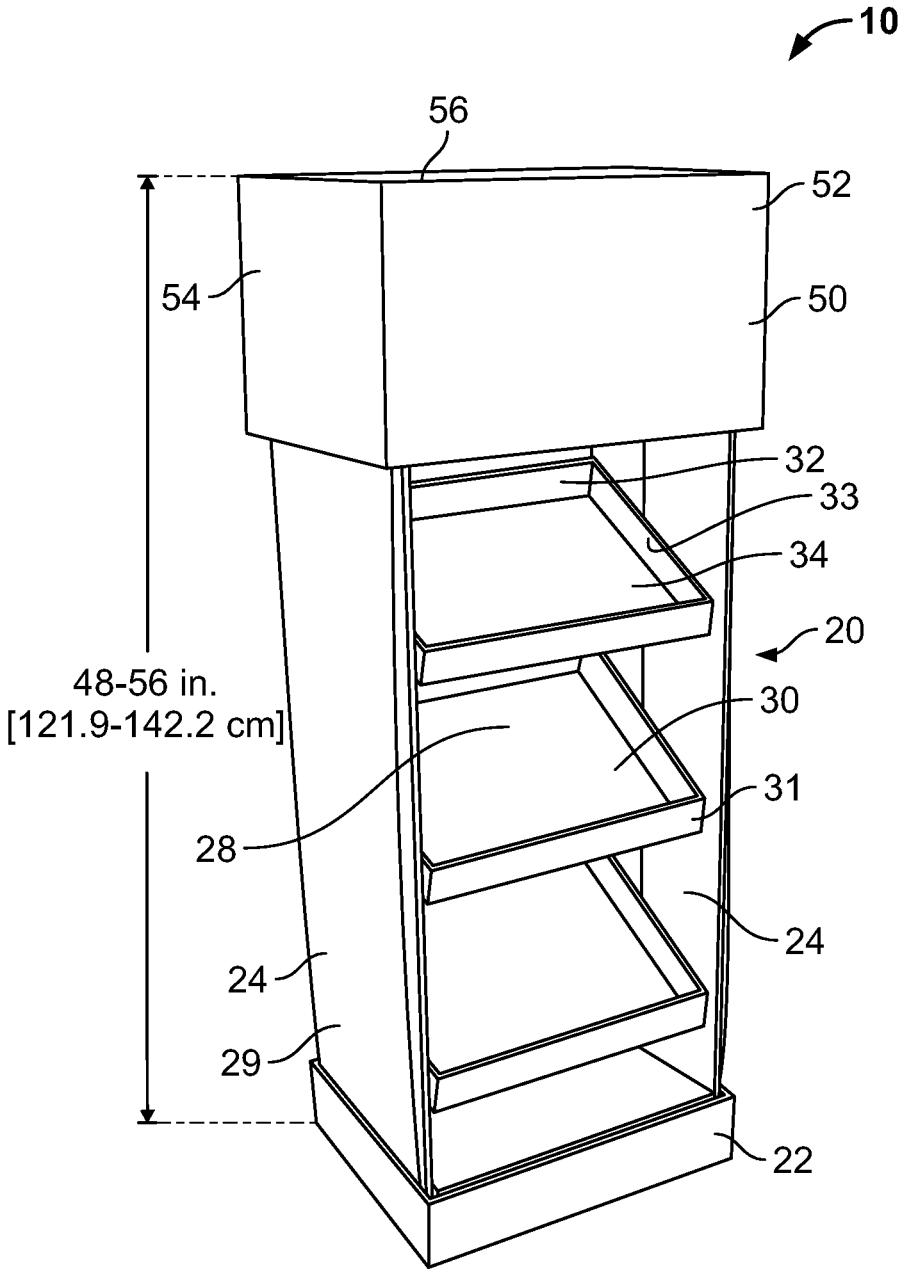
FIG. 1 is a perspective view of a display in a display configuration, according to an example aspect.

FIG. 1 shows an illustrative representation of a display in a display configuration, according to an example aspect. Referring to FIG. 1, a product display 10 may include a stand 20 and a header 50. In one example (shown in FIG. 1), the display is generally a rectangular shape. In another example (not shown) the display may be any shape.

Stand 20 may be comprised of a base 22, one or more sides 24, a back 26 (see FIG. 4*b*), an interior 28, and an exterior 29. One or more tray(s) 30 may be disposed in or on the stand 20. A tray 30 may have a front 31, back 32, one or more sides 33, and a bottom 34. In one example a tray is located in the interior 28 of the stand 20. Tray 30 may attach or couple to the stand 20 at one or more sides 24 and/or at the back 26. In some arrangements, tray 30 is removably coupled to the stand 20. However, in other arrangements, tray 30 is permanently coupled to the stand 20 by an adhesive or clip, for example.

Figure 4A:
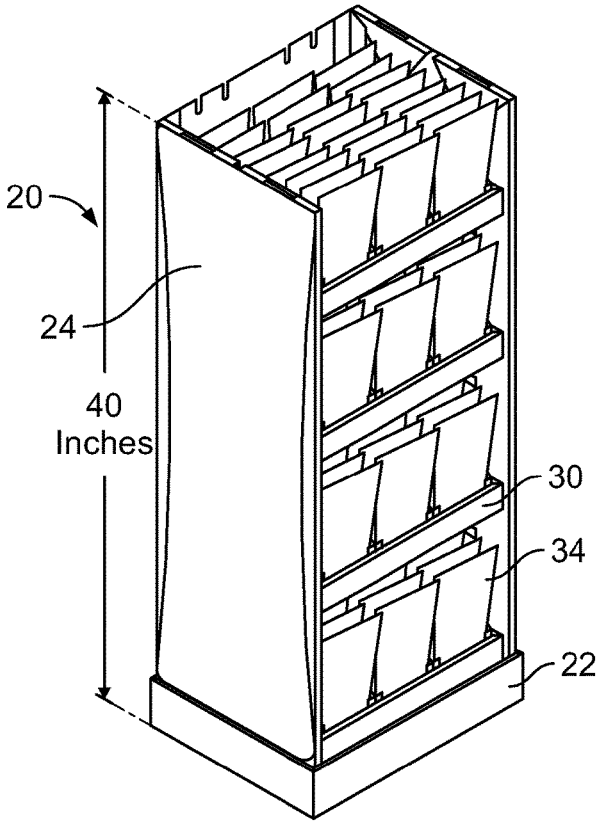
FIG. 4A is a perspective view of the display shown in FIG. 1 without a header assembly attached, according to one example aspect.

Tray 30 may be configured to hold a plurality of consumer products (see FIG. 4*a*). Tray 30 may be shaped like a bin or a shelf or any shape that is configured to display a product. The tray 30 may have one or more fenestrations (not shown) designed to hold one or more products.

Tray 30 may be angled relative to the surface upon which the stand 20 sits. In some arrangements, the tray display angle is 90 degrees to the back of the stand 20 such that the tray 30 is perpendicular to a surface upon which the stand 20 sits. In other arrangements, the tray display angle from the back of the stand to the bottom of the tray is less than 90 degrees such that the tray 30 is not perpendicular relative to the surface upon which the stand 20 sits but rather is downwardly angled (as shown in FIG. 1). In other arrangements, the tray display angle may be more than 90 degrees from the back of the stand to the bottom of the tray such that the tray tilts upwardly.

In one example, the display 10 displays consumer products (not shown in FIG. 1). The consumer products may include any of a variety of consumer goods or consumer packaged goods such as food products, office supplies, batteries, and so on. The consumer products may be arranged and presented to consumers in tray 30, which may be sized and shaped to accommodate the consumer products. Alternatively, the consumer product may be positioned in or on the stand 20 without any tray for support.

The display 10 may have a merchandising header 50 attached to the stand 20. In alternative aspect, the display 10 may not have a header attached to the stand. Headers can display a brand, product, graphics, or message. They can add additional height to the display and can be an effective tool to help gain shopper's attention.

In one example, an assembled header 50 is a rectangular shape with a front 52, two sides 54, a top 56, and back 58 (not shown in FIG. 1) and an open base 59 (not shown in FIG. 1, see FIG. 3E). The header 50 may have an interior and an exterior. The header 50 may be any shape. Other arrangements of headers may have different numbers or configurations of walls, edges, and shapes. The shape may allow for graphics to be displayed on all external sides of the header to create an attractive display.

Header 50 can be located near the top of a stand 20. Header 50 can be any size but in one example it is approximately 15 inches wide, 12 inches deep, and 10 inches tall. Header 50 can add height to a stand 20, thereby extending the total height of the display 10. In one aspect, header 50 extends the height of the display from approximately 36-44 inches to approximately 48-56 inches (121-143 cm). Headers can be coupled or attached to a stand by friction or manual application, for example. Header 50 may be longitudinally moveable as described below and as shown in the figures. In other words, the header 50 may move from one position relative to the stand 20 to another position relative to the stand 20.

The display 10 may be configured to have a shipping configuration and a display configuration. FIG. 1 shows the display 10 in a display configuration (a configuration that would be seen where goods are sold.) When the display 10 is in a display configuration it is taller than it is in the shipping configuration. In one example, the display is approximately 48-56 inches tall in the display configuration and 40 inches or less tall in the shipping configuration. As is described below, a moveable header allows an increase in overall height of a display from one height to another height by utilizing the motion of lifting the header that covers the display during shipping.

Each component of the product display 10 may be composed of any of a variety of rigid materials including paperboard, fiberboard, pulpboard, corrugated board, plastic, metal, and so on. The components may be composed of combinations of such materials. Such materials may further be laminated or coated and may include corrugation.

Figure 2:
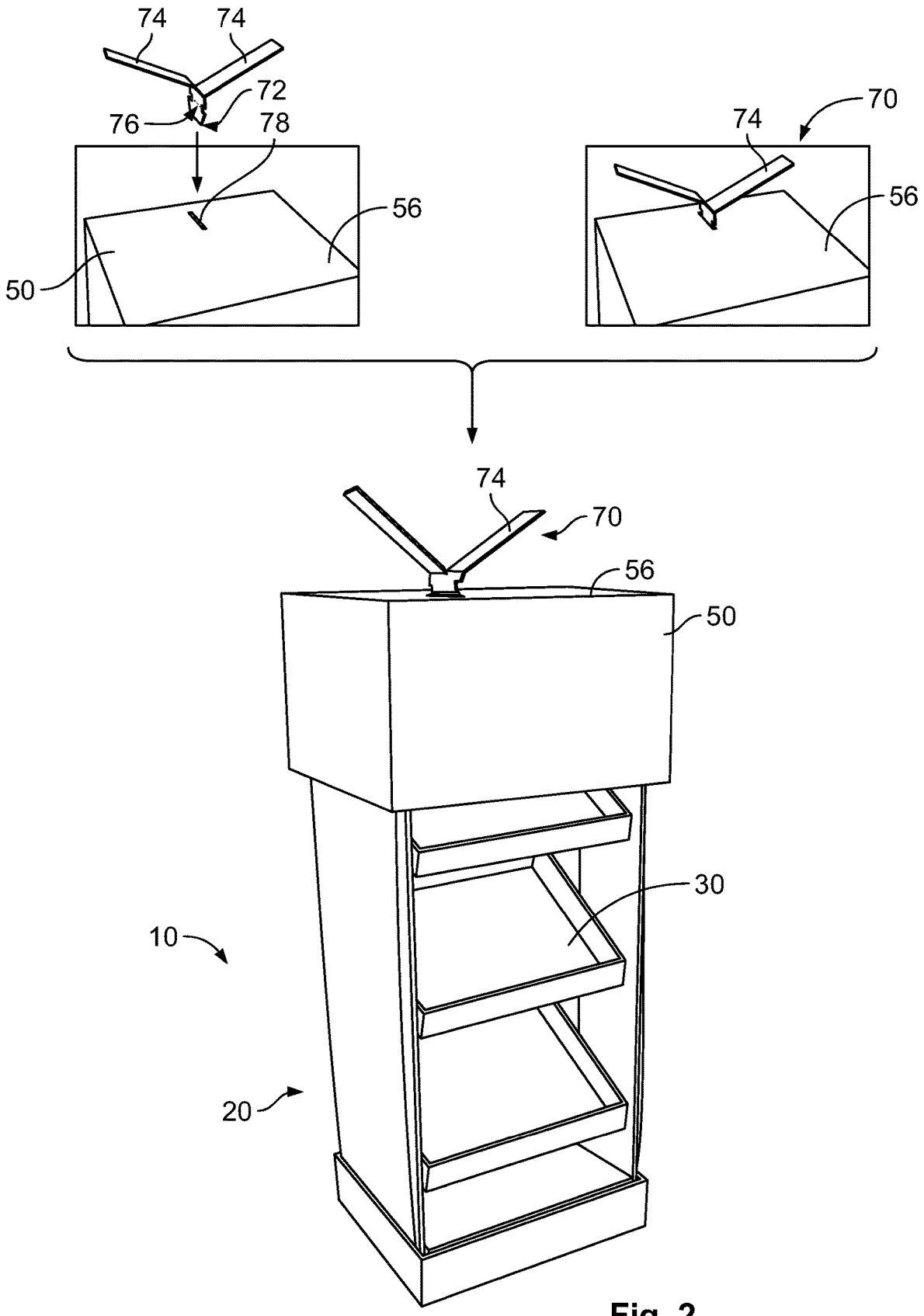
FIG. 2 is a perspective view of the display shown in FIG. 1 in a shipping configuration, according to an example aspect.

FIG. 2 shows one example of the display 10 of FIG. 1 in a shipping configuration, in an example aspect. In the shipping configuration the header 50 is positioned lower relative to the stand 20 so that the overall height of the display 10 is reduced. In other words, in the shipping configuration the header 50 will cover more of the stand than the display configuration.

In North America, tractor trailers have an internal height of approximately 110 inches from floor to ceiling. In one example display 10 is preferably 40 inches (101.6 cm) or less tall to allow it to be easily double stacked during transportation from where it is manufactured to the retail establishment where it will be displayed. In one example display 10 is 40 inches and stacked on a 6-inch pallet. Double stacking two 40-inch displays would be approximately 92 inches and allow for approximately 18 inches of clearance on a standard tractor trailer. Displays that are taller than 40 inches are less desirable for double stacking because the amount of clearance is limited and therefore it is difficult to load and unload a trailer. Pallets capable of double-stacking displays result in 50% reduction in the number of trailers required to move finished displays that can otherwise only be single-stacked. The reduction in the space needed and number of trailers needed to move multiple displays can result in reduced transportation cost.

Other countries or different trailers may have different heights. In one aspect, the display is configured to be double stacked during transportation in trailers of alternative heights. Displays in the shipping configuration are typically sized so that they may be double stacked during transportation to save on shipping costs. For warehousing, non-optimized display heights result in single stacked pallets and inefficacies in utilizing warehouse space.

In one example, when the display 10 is in the shorter shipping configuration the header 50 sits lower on the stand 20 so that one or more trays 30 may be partially or fully covered by the header 50. In one example, one or more trays 30 will be revealed or exposed when the header 50 is lifted into the display configuration as shown previously in FIG. 1.

A perforated tab 70 may extend beyond the top of the header 56 when the display 10 is in the shipping configuration. Perforated tab 70 may be comprised of an elongated element with an engagement end 72 and one or more pull strips 74 extending from the engagement end 72. The engagement end 72 may be configured to be received in an opening 78 in the top of the header 56. In one example, when in the shipping configuration the engagement end 72 of the tab 70 is hidden from view and disposed under the top 56 of the header 50. Pull strips 74 may be visible as extending from the top 56 of the header 50. Perforated tab 70 may also have a score line 76 defined as a line of weakening that may be between the engagement end 72 and the pull strips 74. In one aspect, perforated tab 70 may have multiple score lines. In one example score line 76 is parallel to the top of the header 56. The score line 76 may allow for separation of the pull strips 74 from the engagement end 72 of the tab 70. In one example the tab 70 is separated along the score line 76 when the display goes from the shipping configuration to the display configuration. In one example, pull strips 74 are attached to the inside top flaps of the container in which it is shipped and after the display is extended to its maximum height the pull strips 74 will tear away from the engagement end 72. In that example the pull strips 74 may remain attached to the container flaps and the engagement end 72 will remain inside the header or remain attached to the top of the header but not be visible. In another example after the display is extended to its maximum height the pull strips 74 may tear off from the engagement end 72 of the tab 70 and the pull strips 74 may be discarded. In one example when the display 10 is in the display configuration the tab 70 is not visible to consumers looking at the display 10. It is understood that each example configuration may be combined with the other example configuration discussed herein.

FIG. 3 is an assembly view of the header shown in FIG. 1, according to an example aspect.

The term "knocked down flat" (KDF) generally refers to a partially assembled or unassembled container that is currently in a relatively flat configuration, typically with fold lines between panels or between panels and flaps arranged at substantially zero or 180 degrees. The KDF is capable of being erected into a container by moving the panels or flaps to 90 degrees at their folds, often by pressing endwise inwardly on the ends of a KDF forming a flattened parallelogram. Flat sheets of corrugated paperboard, sometimes referred to as blanks, have been used for many years as the starting material to form containers. A KDF may include one or more blanks, where the one or more blanks may be adhered together at adhesion points. The terms "carton," "container," "display" and "box" may generally be used interchangeably to generally mean a structure, generally having a box shape, in which consumer goods and/or product may be shipped, transported and/or displayed to consumers in stores. Term "blank" generally means a flat sheet of some material, for example paperboard, that is ready to be folded into and become a portion of a container, or the whole container. The blanks and/or KDFs and/or containers of the aspects described herein are typically manufactured using corrugated paperboard, for example with the corrugations running in a vertical direction for good compression strength in a vertical direction for stacking As non-limiting examples, the containers may be manufactured from C-flute, EB-flute, E-flute or B-flute corrugated paperboard. It is to be understood that the principles of one or more aspects of this disclosure may be applied to containers made of other materials, such as non-corrugated paperboards, cardboard, corrugated fiberboard, non-corrugated fiberboard solid-fiber board, polymeric materials, and other foldable materials. It should also be understood that the principles of one or more aspects of this disclosure may be applied to containers of varying styles, for example HSC-style containers or other styles of corrugated boxes or non-corrugated boxes.

A header may be assembled from one or more blanks of paperboard, plastic, paper, metal, and so on. In one example, header 50 is a made of corrugated paperboard and includes a multi-layer sheet material comprised of two sheets of liner bonded to a central corrugated layer. In another example, header 50 is made of combinations of materials.

FIG. 3 shows the steps in forming a header 250 by using one blank according to one aspect of the invention. The blank may be shipped flat (not erected) and erected by a user or machine when a header is needed. In one example the header is erected when the stand is erected so that the fully assembled display (including the stand and header) are transported in an assembled state to a retail establishment.

As shown in FIG. 3*a*, blank 200 may be provided which includes a central portion 262 that will form a top 256 of the header and one or more sets of flaps that will form sides 254 (including side panels and end panels). The central portion 262 may have a slot 78 configured to receive a header engagement tab (not shown in FIG. 3). The central portion 262 may be generally rectangular shaped and linked to four flaps 266, 268, 270, 272. In one example flaps 266 and 268 may each have one or more wings 274. In one example flaps 270 and 272 may each have an extension 276. In one example one or more extension 276 may have a header lock 260. The header lock 260 may have four sides where three sides are die cut and one side is uncut 286.

Blank 200 may be scored and slotted to permit folding and/or erecting. In one example there is one or more fold lines 278 between flap 266 and wing 274. In one example there is one or more fold lines between flap 268 and wing 274. In one example there is a fold line 280 between flap 266 and central portion 262. In one example there is a fold line 280 between flap 268 and central portion 262. In one example there is a fold line 282 between extension 276 and 270. In one example there is a fold line 282 between flap 272 and extension 276. In one example there is a fold line 284 between flap 270 and central portion 262. In one example there is a fold line 284 between flap 272 and central portion 262.

As shown in FIG. 3*a*, inside wings 274 may be folded inwardly along fold line 278.

As shown in FIG. 3*b*, two of the flaps 266 and 268 may be folded inwardly along fold line 280.

As shown in FIG. 3*c*, extensions 276 may be folded inwardly at fold line 282.

As shown in FIG. 3*d* the extensions 276 may be tucked into the interior of the header 250. Flaps 272 and 270 may fold inwardly at fold line 284. In one example the extensions 276 are engaged with the inside wings 274 through fiction fit or through an adhesive.

FIG. 3*e* shows the final assembled header 250 using the steps outlined above as shown in FIGS. 3*a-e*. In one example, the assembled header 250 has 4 sides 254, a top 256, and an open base 59.

Figure 4B:
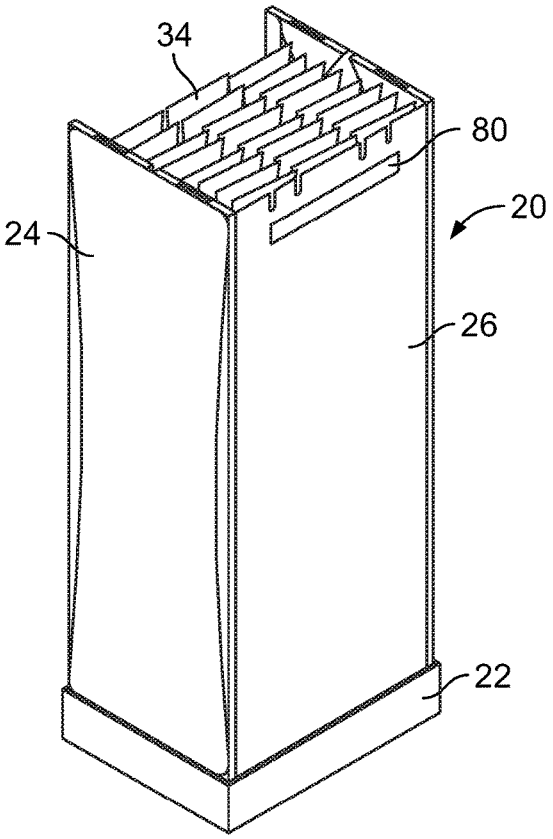
FIG. 4*b* is a perspective view of the display shown in FIG. 1 without a header assembly attached.
Figure 5A:
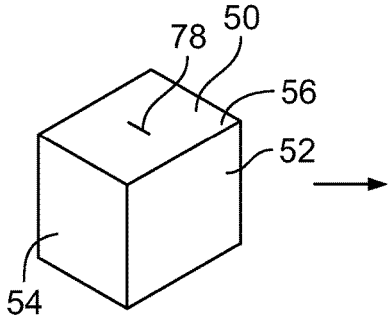
FIGS. 5A-5D are an assembly view of the display shown in FIG. 2, according to an example aspect.
Figure 5B:
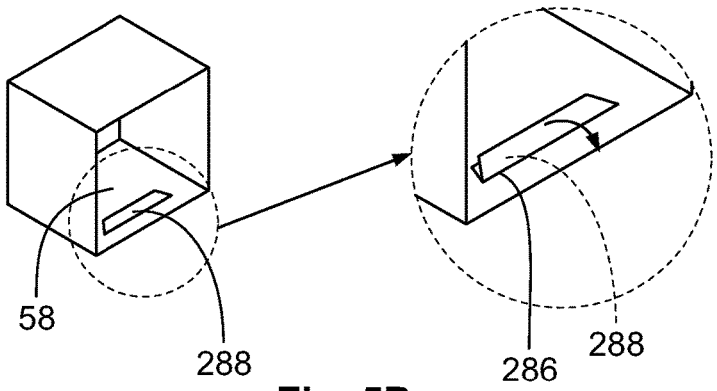
Figure 5C:
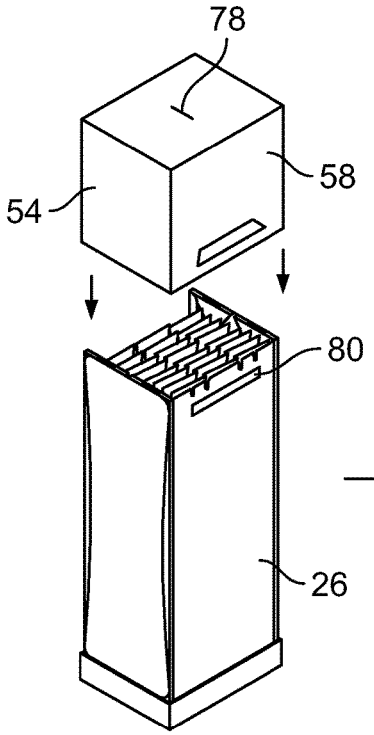
Figure 5D:
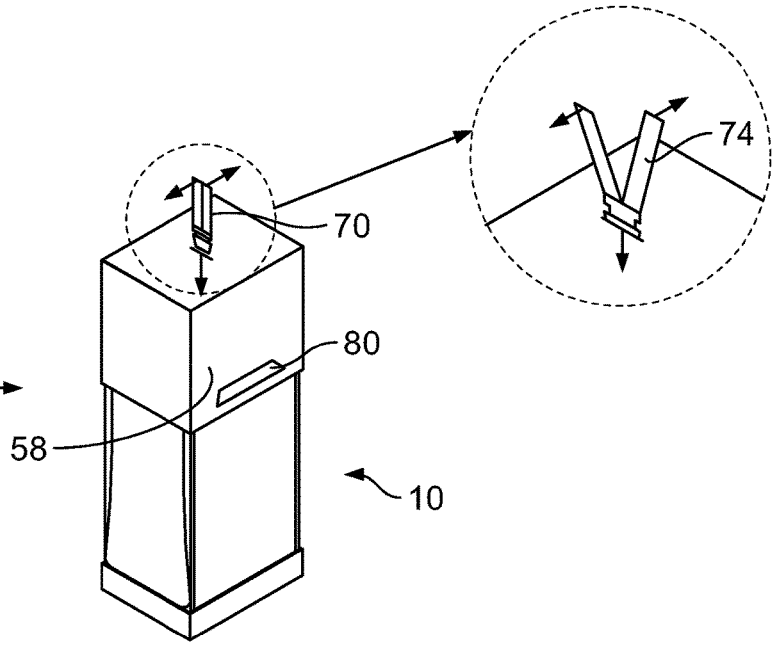

FIG. 4 shows one aspect of a stand 20 displaying a number of goods 34 on tray 30. In one example, the stand 20 is approximately 40 inches tall, e.g. 30-40 inches, or 40-60 inches or 30-80 inches, etc. In one example, the tray 30 is configured to hold a plurality of goods 34 such as food or drink items. The stand 20 may have a base 22, two sides 24, and a back 26. The back 26 of stand 20, shown in FIG. 4*b*, may have a header lock cutout 80. Header lock cutout 80 may be an elongated opening in the back of the stand 20. The header lock cutout 80 may be configured to receive a header lock tab as described below.

FIG. 5 shows the steps of assembling a display 10 into a shipping configuration. FIG. 5*a* shows header 50 in an upright position with a front 52, two sides 54, back 58 with an opening 78 in the top 56. FIG. 5*b* shows the header 50 resting on its back 58. The back 58 may have an elongated header lock tab 288. The header lock tab 288 may be an elongated material that is partially affixed to the header 50 or it may be a partial cutout of the header back 58. The cut sides may fold over the uncut side 286 to create a header lock tab 288. As the header extends upwardly during assembly of the display the header lock tab 288 will engage a header lock cutout 80 in the back 26 of the display. This engagement may prevent the header from coming off the display 10. FIG. 5*c* shows a header being placed on top of stand 20. The header 50 is aligned so that the back 58 of the header is adjacent to the back 26 of the stand 20. In this way the header lock cutout 80 will be aligned to receive the header lock tab 288 when the display goes from the shipping to the display configuration. As shown in FIGS. 5*c* and 5*d*, header 50 may be pushed down onto the stand until it cannot be pushed any further. FIG. 5*d* shows the display with the header 50 assembled on the stand 20 in the shipping configuration. Perforated tab 70 may be inserted in the opening 78 on top of the header 50 so that the engagement end 72 is engaged with the header 50. Pull strips 74 may be pulled in opposite directions. In an aspect, the pull strips 74 may be pulled diagonally, or across each other.

FIG. 6 shows the packing of an assembled display 10 in the shipping configuration into a container 300 according to one aspect of the invention. A display 10 in a shipping configuration is packed into a container 300 for transport or storage. Container 300 may be configured to at least partially cover display 10 and keep the display 10 in a shipping configuration. In some arrangements, the container 300 is configured to completely enclose the display 10 within its walls. In other arrangements, the container 300 includes a member that wraps around the display 10 but does not enclose the entire display 10. In yet other arrangements, the container 300 is an overwrap (e.g., cellophane) around the display 10.

Container 300 may be any size and shape to partially or fully enclose or encase the display 10. In one aspect the container 300 is a box with 4 sides 302, a top 304, and no bottom. The container 300 may have a bottom or it may not have a bottom. The top 304 of container 300 may have a plurality of flaps 303 that move from an open configuration to a closed configuration. In one example, when four flaps 303 are folded inwardly there may be two inside flaps and two outside flaps. In one example, the flaps 303 may be folded inwardly such that the top is approximately parallel with the ground when it is in a closed configuration. In another example, one or more flaps 303 may fold outwardly from the container 300 such that an assembler may access the contents of the container 300 and therefore it is in the open configuration.

Figure 6A:
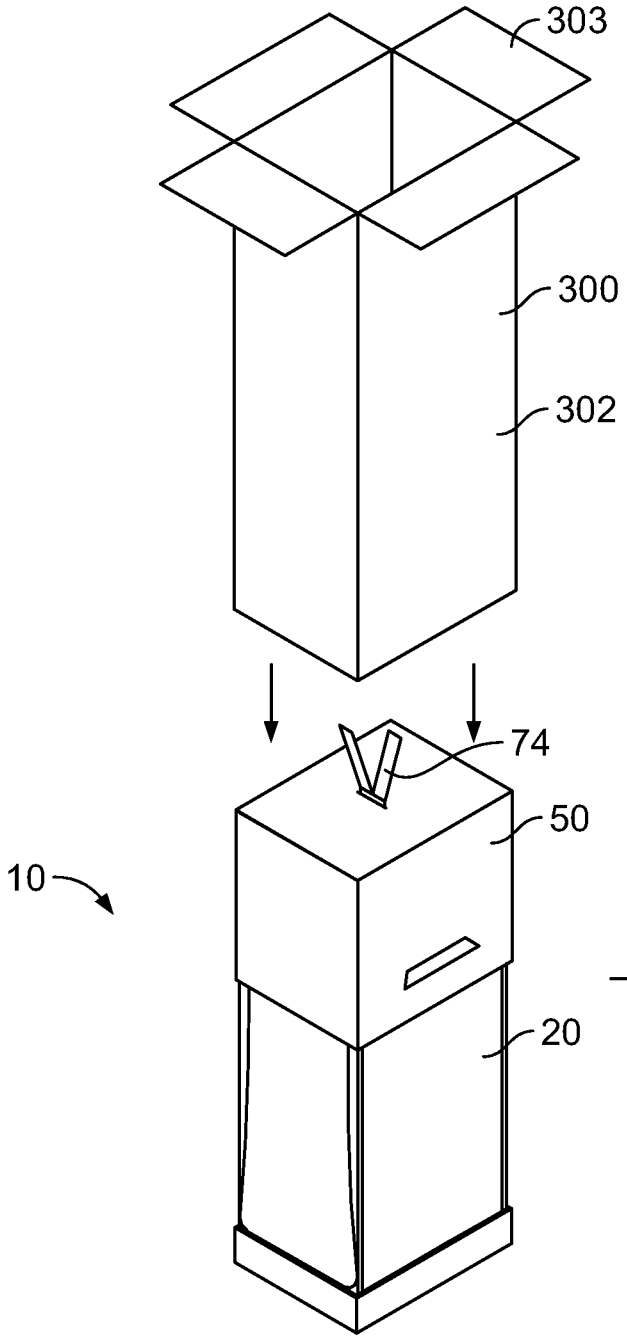
FIGS. 6A-6I are an assembly view of a container covering the display shown in FIG. 1, according to an example aspect.
Figure 6B:
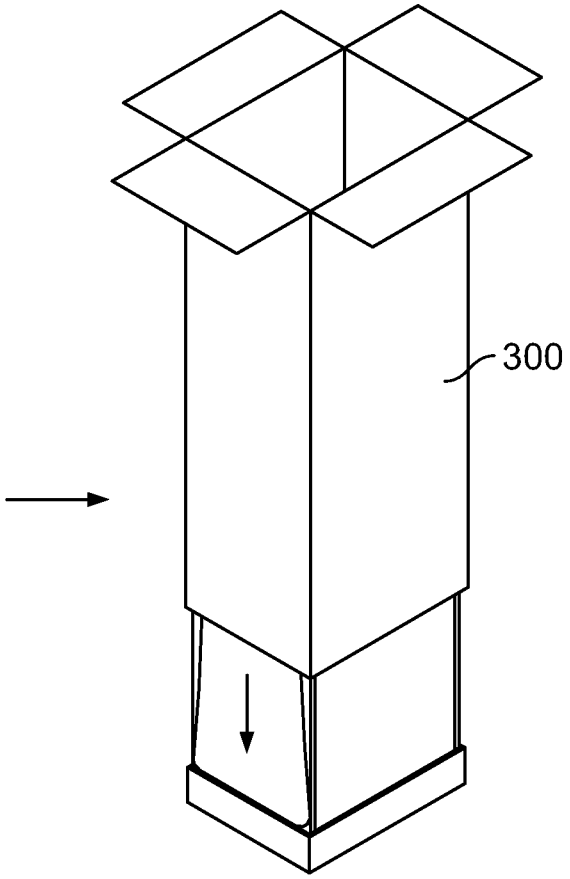
Figure 6C:
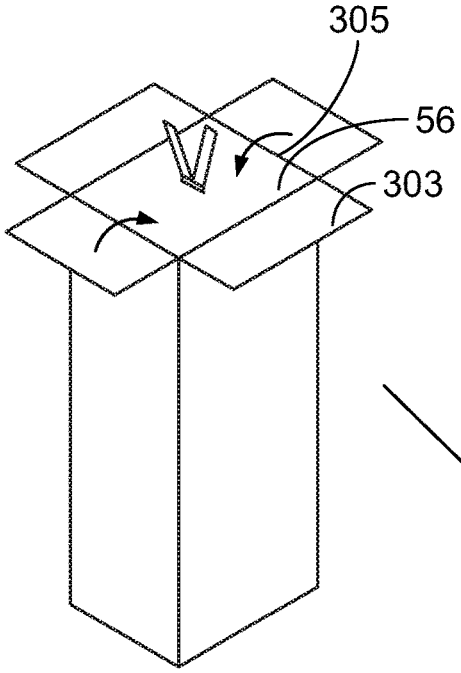
Figure 6D:
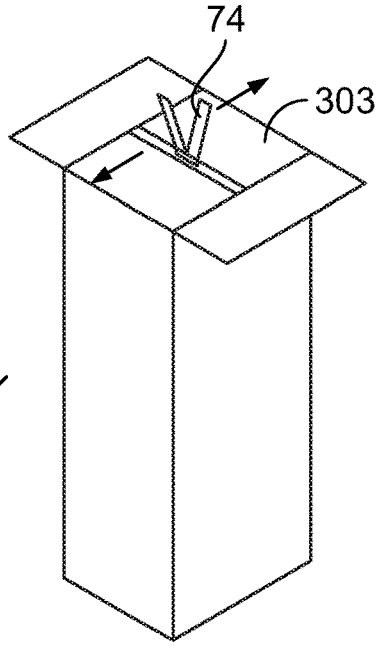
Figure 6E:
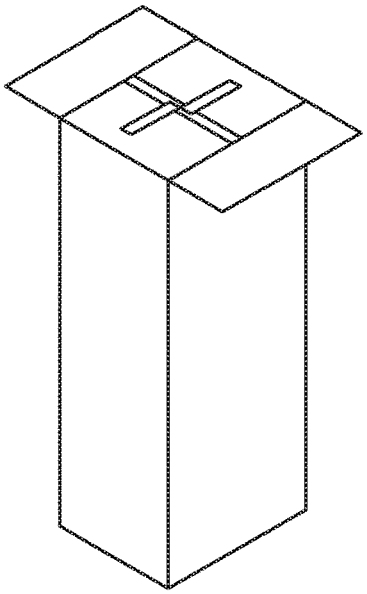

As shown in FIGS. 6*a* and 6*b*, in one aspect the bottom edge of container 300 may be placed over the top of display and slid down the sides of the display 10 to cover the exterior stand 20 of the display 10. As shown in FIG. 6*c*, two inside flaps 303 on container 300 may be inwardly folded along two-fold lines 305 located near the sides of header 50. The flaps 303 may be folded inwardly until they are approximately parallel with the top 56 of header 50.

Figure 6F:
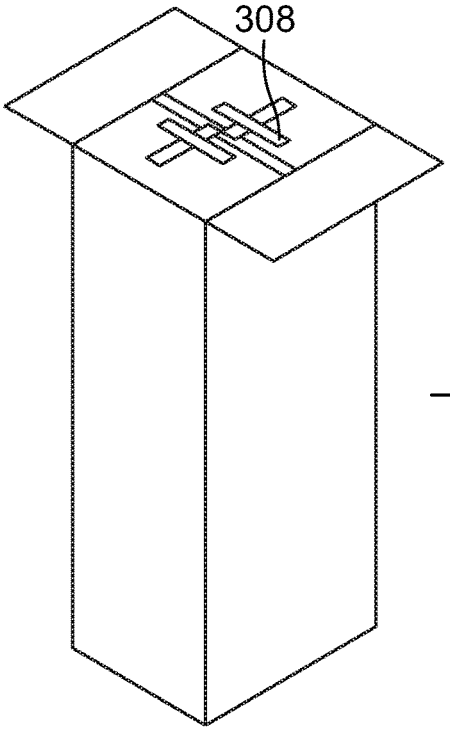
Figure 6G:
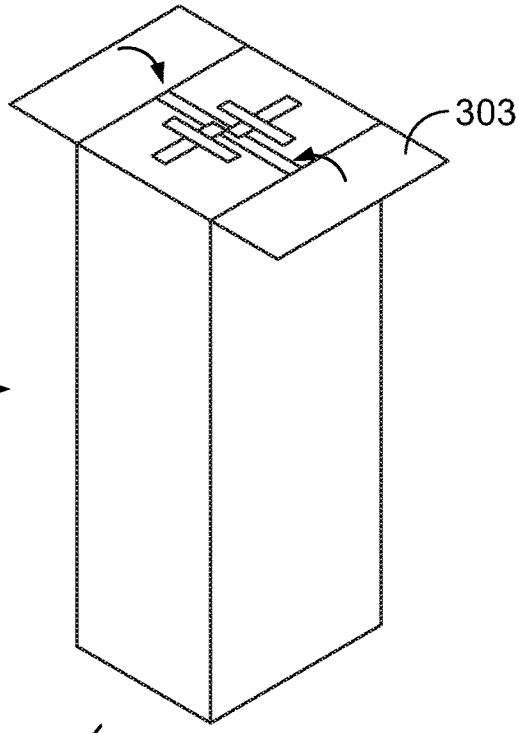
Figure 6H:
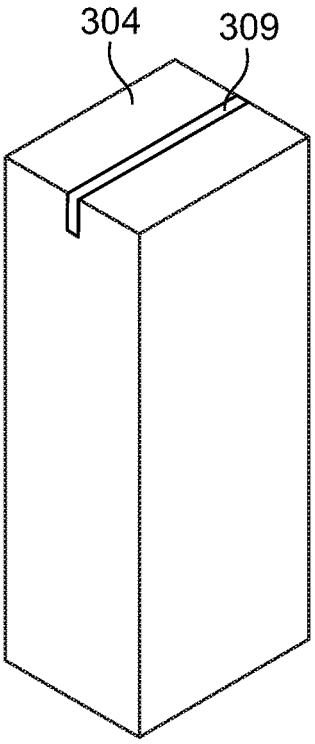

When two flaps 303 area folded in such that they are approximately parallel with the top 56 of the header 50, the two pull strips 74 may be separated (see FIGS. 6D and 6E) and releasably attached or secured to one or more flaps 303 on the container using any suitable method (see FIG. 6F). In one example, one pull strip 74 is secured to one inside flap 303 and another pull strip 74 is secured to another inside flap 303. In one example the pull strips 74 may be releasably attached using packing tape 308. Other methods of releasably attaching the pull strips 74 to the top inside flaps 303 of container 300 glue, tape, adhesive, etc. The pull strips 74 could alternatively be releasably attached to the container 300 by threading the pull strips 74 through a slit in the top inside flap and using the outside flap to provide friction to hold it in place during shipment (not shown).

Figure 6I:
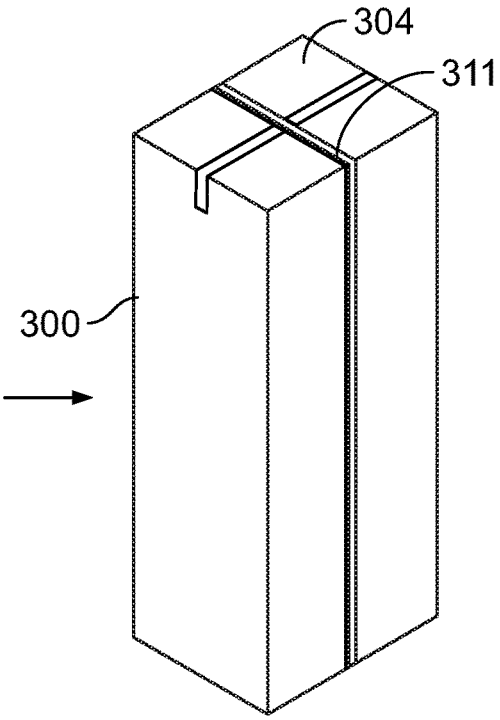

Once the pull strips 74 are secured to container top flaps 303, the remaining two container top flaps 303 may be inwardly folded along fold lines (see FIG. 6G) and the container may be secured using a piece of tape 309. The container top 304 may also be secured using another other solution known in the prior art. Lastly the container may have a band 311 securing the entire container 300 as shown in FIG. 6I. In one example the band 311 is plastic and is configured to protect the display and all content until the container arrives at its final destination (such as a store).

Figure 7A:
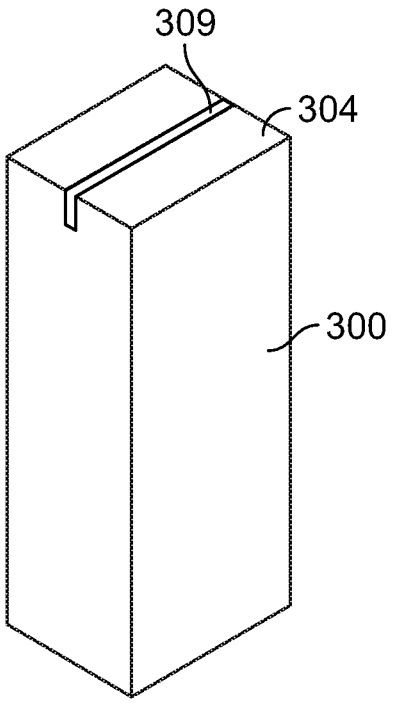
FIGS. 7A-7C are an assembly view of the display shown in FIG. 1 going from a shipping configuration to a display configuration, according to an example aspect.
Figure 7B:
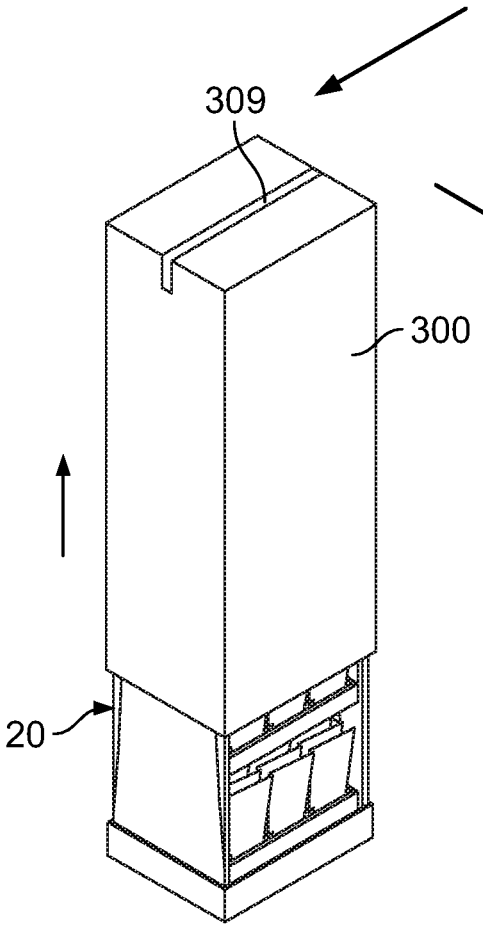
Figure 7C:
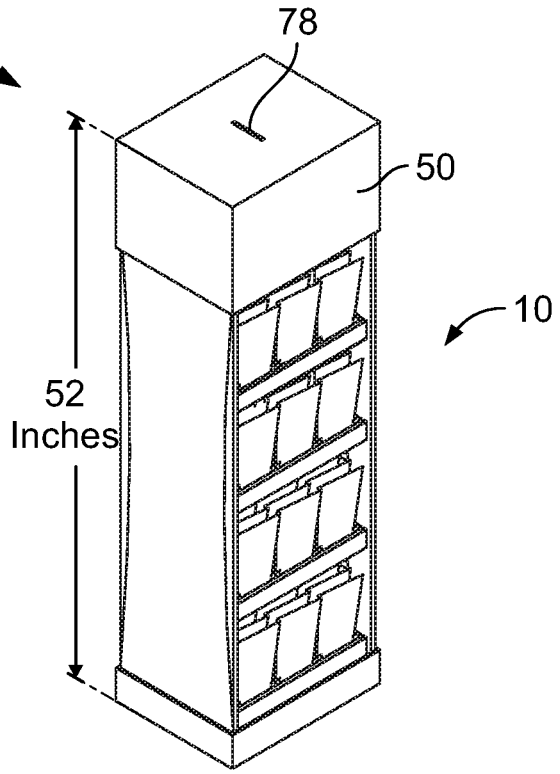

FIGS. 7*a-c* shows one example of a display 10 in a container 300 going from a shipping configuration to a display configuration. In one example the display 10 may be provided to a retailer in a container 300 (FIG. 7*a*). The user may open the container 300 by removing band 311 (see FIG. 6I) and pulling the container 300 upwardly while the display 10 stays anchored to the ground (FIG. 7*b*). As the container 300 moves up and reveals the display 10, the flaps 303 will correspondingly engage the pull strips 74 (which are secured to the flaps 303). The pull strips 74 in turn will pull the header upwardly from a shipping configuration to a predetermined height for a display configuration. The header 50 will lock into place at a pre-configured height in a display configuration. After a certain amount of force is applied to remove the container 300 from the display 10, the pull strips 74 will separate from the engagement end 72 of the perforated tab 70 along score line 76. As a result, when the display is in the display configuration no perforated tab 70 will be visible (FIG. 7*c*). The retailer may then place the display on the floor (or a shelf) to allow customers access to products and dispose of container 300. (In another example, not shown, the display may be shipped without products to be sold and a retailer may need to add products to be sold to the display after it is assembled at the retail establishment.)

Figure 8:
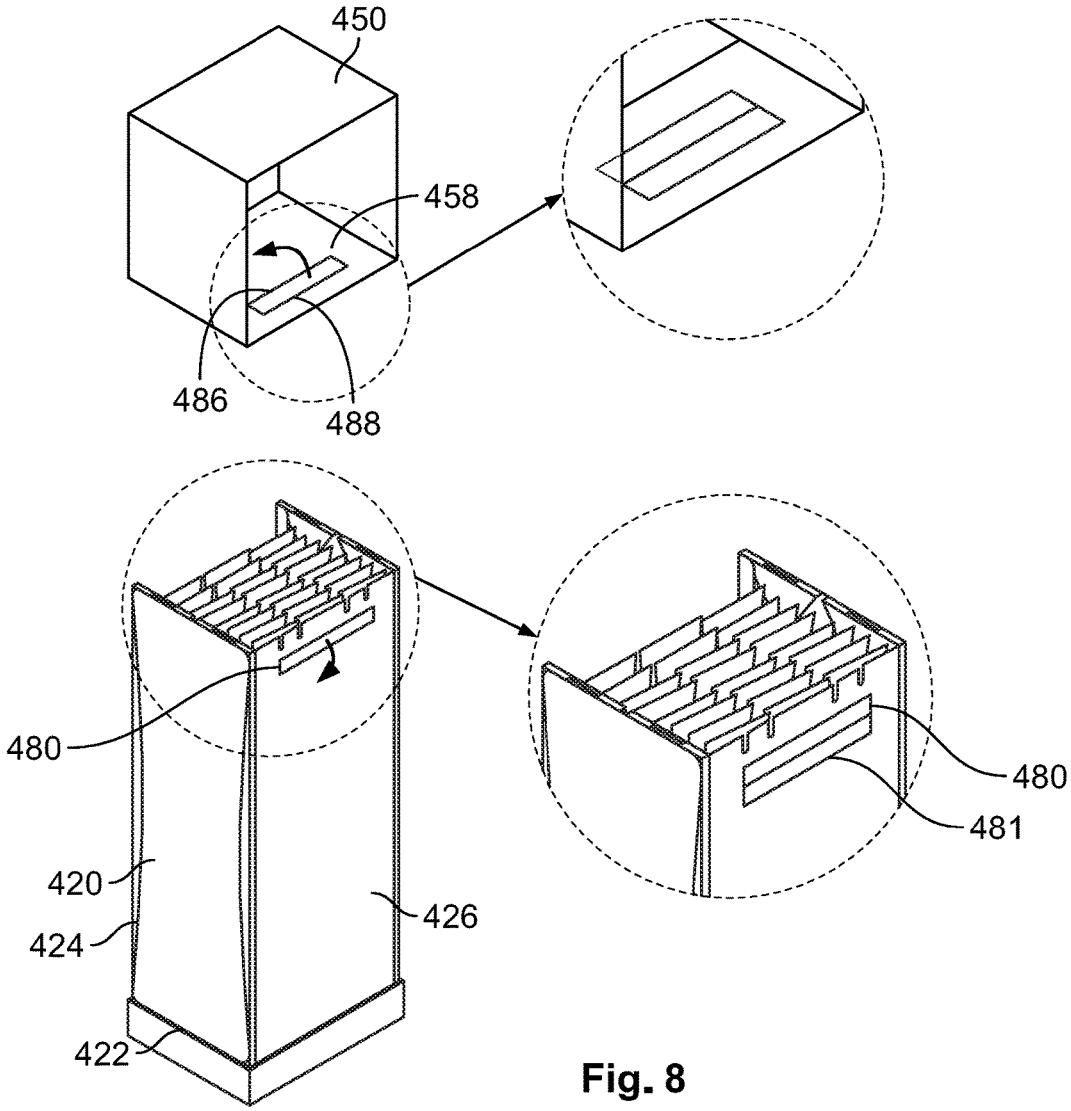
FIG. 8 is a perspective drawing of the stand and header shown in FIG. 1 with an alternative header lock tab and header lock cutout, according to an example aspect.
Figure 9:
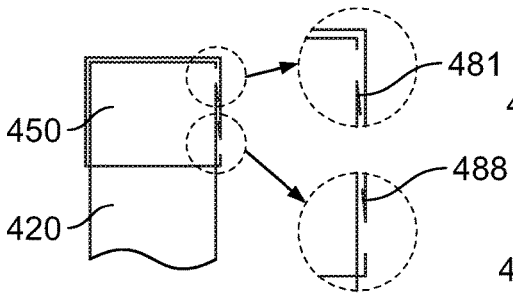
FIG. 9 is a cross-sectional view of the display shown in FIG. 8 in a shipping configuration, according to an example aspect.
Figure 10:
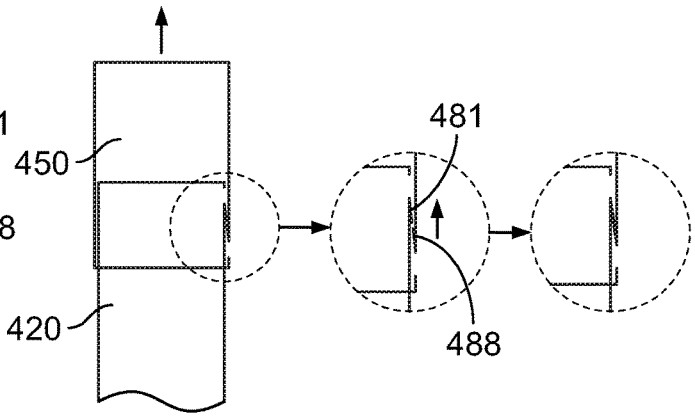
FIG. 10 is a cross-sectional view of the display shown in FIG. 9 in a display configuration, according to an example aspect.

FIGS. 8-10 show one example of display with an alternative header lock system. As shown in FIGS. 8-10, in one aspect stand 420 may has a base 422, two sides 424, and a back 426. The back 426 of stand 420 may have a stand cutout 480. The stand cutout 480 may be an elongated cutout that is partially affixed to the stand 420. In one example, one portion of the stand cutout 480 is integrated with the stand 420 and the other sides may be folded outwardly so that a stand tab 481 is at an outward angle to the back of the stand 426. The stand tab 481 may be configured to receive the alternative header lock tab 488 found on the header 450.

FIG. 8 shows a header 450 resting on its back 458. The back 458 may have an elongated header lock tab 488. The header lock tab 488 may be an elongated material that is partially affixed to the header 450. One or more cut sides may fold over an uncut side 486 to create a header lock tab 488. As the header extends upwardly along the stand during assembly of the display the header lock tab 488 will engage stand tab 481 in the back 426 of the display. This engagement will prevent the header from coming off the display.

FIG. 9 shows a cross-sectional view of the header 450 and stand 420 in a shipping configuration. When the display is in the shipping configuration the header lock tab 488 and stand tab 481 are not engaged.

FIG. 10 shows a cross-sectional view of the header 450 and stand 420 in a display configuration. When the header 450 is vertically pulled from a shipping configuration to a display configuration the stand tab 481 and header lock tab 488 are engaged. When the stand tab 481 and header lock tab 488 are engaged the header 450 is prevented from falling back down and therefore the header will not go back into the shipping configuration. The engagement also prevents the header 450 from being pulled off the top of the stand 420.

Using the header lock system shown in FIGS. 1-8 or the alternative header lock system shown in FIGS. 8-10 allow the display to easily convert from a shorter shipping configuration to a taller display configuration with minimal effort.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative aspects. Accordingly, all such modifications are intended to be included within the scope of the present disclosure as defined in the appended claims.

The foregoing description of aspects of the invention aspect has been presented for purposes of illustration and description. It is not intended to be exhaustive or to limit the disclosure to the precise form disclosed, and modifications and variations are possible in light of the above teachings or may be acquired from this disclosure. The aspects were chosen and described in order to explain the principals of the disclosure and its practical application to enable one skilled in the art to utilize the various aspects and with various modifications as are suited to the particular use contemplated. Other substitutions, modifications, changes and omissions may be made in the design, operating conditions and arrangement of the aspects without departing from the scope of the present disclosure as expressed in the appended claims.

What is claimed is:

1. A display comprising:

a stand adapted to support product for display in a retail location; and, a header coupled to the stand and covering an exterior portion of the stand;

wherein the display is configured to go from a first configuration to a second configuration, and wherein the display in the first configuration is shorter than the display in the second configuration.

2. The display of claim 1, wherein the first configuration is a shipping configuration and the second configuration is a display configuration.

3. The display of claim 2, wherein when the display is in shipping configuration it is approximately 40 inches or less tall.

4. The display of claim 1, wherein the header is moveable relative to the stand.

5. The display of claim 4, further comprising a tab, wherein the tab attached to the header enables the header to move relative to the stand.

6. The display of claim 5, wherein the tab is perforated.

7. The display of claim 5, wherein when the display is in the second configuration the tab is not visible.

8. The display of claim 1, wherein the stand comprises a plurality of trays configured to support a product.

9. The display of claim 1, wherein the display further comprises a shelf configured to hold at least one packaged good.

10. The display of claim 1, wherein the display further comprises a locking mechanism.

11. The display of claim 10, wherein the locking mechanism further comprises a tab on the stand and a tab on the header and when the two tabs are engaged the display is prevented from going into the first configuration.

12. The display of claim 1, wherein the second configuration is at least 6 inches taller than the first configuration.

13. A method of assembling a merchandising header for a display wherein the merchandising header is formed from a single blank, the method comprising the steps of pulling the merchandising header along an exterior portion of a stand such that a total height of the display increases.

14. A method of configuring an expandable display from a shipping configuration into a display configuration, the method comprising the steps of:

(a.) providing the expandable display comprising (1) a stand and (2) a header coupled to the stand;

(b.) pulling the header along an exterior portion of the stand such that the total height of the expandable display increases.

15. A method of configuring an expandable display from a shipping configuration into a display configuration, the method comprising:

(a.) providing the expandable display comprising (1) a stand and (2) a header coupled to the stand, where the display is contained in a container;

(b.) removing the container from the expandable display; and (c.) pulling the header along an exterior portion of the stand such that the total height of the expandable display increases.

16. A method of configuring an expandable display from a shipping configuration into a display configuration, the method comprising:

(a.) providing the expandable display comprising (1) a stand and (2) a header coupled to the stand and (3) a perforated tab with two ends, wherein one end of the tab is engaged with the header and another end of the tab is engaged with a container; and (b.) removing the container such that the expandable display is revealed.

17. The method of claim 16, the method further comprising separating the tab along a score line during removal of the container.

18. A method of converting a display in a shipping configuration into a display configuration, the method comprising:

(a.) providing the display that comprises (1) a stand and (2) a header coupled to the stand, wherein the header encloses a portion of the stand; and (b.) vertically pulling the header along the stand to reveal the stand that was enclosed by the header.

19. The method of claim 18, the method further comprising:

(a.) stopping vertically pulling the header after a locking mechanism on the header has been engaged so that the header cannot move back to a previous configuration.

* * * * *